US007770765B2

(12) United States Patent
Stevens et al.

(10) Patent No.: US 7,770,765 B2
(45) Date of Patent: Aug. 10, 2010

(54) MULTI-MODAL WEARABLE BABY CARRIER

(76) Inventors: Robyn Stevens, 2934 1/2 Beverly Glen Cir., #447, Bel Air, CA (US) 90077; Valerie Lambert, 101 S. Loring Ave., Los Angeles, CA (US) 90024

( * ) Notice: Subject to any disclaimer, the term of this patent is extended or adjusted under 35 U.S.C. 154(b) by 512 days.

(21) Appl. No.: 11/132,743

(22) Filed: May 19, 2005

(65) Prior Publication Data

US 2005/0258202 A1 Nov. 24, 2005

Related U.S. Application Data

(60) Provisional application No. 60/572,848, filed on May 20, 2004.

(51) Int. Cl.
*A61G 1/00* (2006.01)
*A45F 4/00* (2006.01)
*A47D 13/02* (2006.01)

(52) U.S. Cl. ..... 224/160; 224/158; 224/159; 224/578; 224/579; 224/580; 224/581

(58) Field of Classification Search ..... 224/158, 224/159, 160, 161, 578, 579, 580, 581; D3/213, D3/214

See application file for complete search history.

(56) References Cited

U.S. PATENT DOCUMENTS

| | | | | | |
|---|---|---|---|---|---|
| 484,065 | A | | 10/1892 | Taylor | |
| 3,327,914 | A | * | 6/1967 | Abram | 224/159 |
| 3,448,826 | A | * | 6/1969 | Rosenblum | 182/3 |
| 3,871,562 | A | | 3/1975 | Grenier | |
| 4,149,687 | A | * | 4/1979 | Nunemacher | 224/159 |
| 4,153,092 | A | * | 5/1979 | Haslam | 150/108 |
| D255,180 | S | | 6/1980 | Raz | |
| 4,234,229 | A | * | 11/1980 | Arnold | 297/467 |
| 4,428,514 | A | * | 1/1984 | Elf | 224/579 |
| 4,436,233 | A | * | 3/1984 | Hill et al. | 224/159 |
| 4,467,945 | A | | 8/1984 | Schaapveld | |
| 4,579,264 | A | | 4/1986 | Napolitano | |
| 4,903,873 | A | | 2/1990 | Poole et al. | |
| 4,941,604 | A | | 7/1990 | Nagareda | |
| 4,986,458 | A | * | 1/1991 | Linday | 224/160 |
| D322,695 | S | | 12/1991 | LaDue | |
| 5,205,450 | A | * | 4/1993 | Derosier | 224/161 |
| 5,205,451 | A | | 4/1993 | Manzer | |
| 5,228,609 | A | * | 7/1993 | Gregory | 224/617 |
| 5,246,152 | A | * | 9/1993 | Dotseth | 224/159 |

(Continued)

*Primary Examiner*—Nathan J Newhouse
*Assistant Examiner*—Lester L Vanterpool
(74) *Attorney, Agent, or Firm*—Sandra P. Thompson; Buchalter Nemer

(57) ABSTRACT

The present invention is directed to a multi-modal wearable baby and small child carrier that is readily adjustable and which, when worn in use, leaves the wearer's arms and hands free. The carrier comprises an elongated strap attached to a flexible sheet-like body wherein the elongated strap can be worn as a neck strap or can be converted to form at least two shoulder straps, and the flexible sheet body is folded to form a positioning portion, so that the user may position the baby or small child directly in front of, or to the left or right side of the torso of an adult who is using and wearing the carrier, such that the baby can be positioned facing toward the adult or facing away from the adult.

8 Claims, 17 Drawing Sheets

U.S. PATENT DOCUMENTS 5,361,952 A * 11/1994 Gold ..... 224/159
5,437,402 A * 8/1995 Ring ..... 224/159
5,490,620 A 2/1996 Bergqvist
D382,395 S 8/1997 Korshamn
D388,247 S 12/1997 McLauchlan
5,772,088 A * 6/1998 Nelson ..... 224/160
5,791,535 A 8/1998 Roan et al.
D397,867 S 9/1998 Fair et al.
5,813,580 A * 9/1998 Fair ..... 224/160
5,871,132 A * 2/1999 Hargreaves ..... 224/576
5,934,528 A * 8/1999 Higuchi ..... 224/159
D425,696 S * 5/2000 Swanke ..... D3/213
D437,996 S 2/2001 Fair et al.
6,325,259 B1 * 12/2001 Tharalson et al. ..... 224/161
D452,993 S 1/2002 Norman
D453,066 S 1/2002 Norman
D455,546 S 4/2002 Norman
6,409,060 B2 6/2002 Donine
6,415,969 B1 * 7/2002 Higuchi ..... 224/160
6,443,339 B1 9/2002 Higuchi
6,666,361 B1 * 12/2003 Lin ..... 224/160
6,672,493 B1 1/2004 Fair et al.
6,763,983 B2 7/2004 Norman
D507,869 S * 8/2005 Liistro et al. ..... D3/214
D551,442 S * 9/2007 Nash ..... D3/213
2001/0030210 A1 10/2001 Donine
2002/0175194 A1 * 11/2002 Norman ..... 224/160
2003/0178452 A1 9/2003 Norman
2005/0076856 A1 4/2005 Bruck et al.

* cited by examiner

MULTI-MODAL WEARABLE BABY CARRIER

CROSS-REFERENCE TO RELATED APPLICATION

This application is a continuation of U.S. provisional patent application Ser. No. 60/572,848, filed on May 20, 2004, titled "Multi-Modal Wearable Baby Carrier Useful in Water".

TECHNICAL FIELD

The present invention is directed to a multi-modal wearable baby and small child carrier. More particularly, the present invention is directed to a unique, novel, and nonobvious wearable baby and small child carrier that is comfortable, easy to use, and safe. This invention pertains to baby and child carriers of the class which are wearable, with a baby or small child supported in the carrier by an adult whereby the adult's hands and arms are free for desired movements without risking the baby's safety. The carrier is especially suited for use in water or aqueous environments, such as in a shower, swimming pool, or spa, and is equally suitable for use on land environments, including snow.

BACKGROUND ART

Baby and child carriers made of fabric or other flexible material and wearable by an adult in a hands-free and arms-free manner, with a carried baby or child positioned in front of the adult's torso, are known. See, for example, U.S. Pat. Nos. 4,467,945, 4,579,264, 4,903,873 and 5,490,620. The baby carrier disclosed in U.S. Pat. No. 4,903,873 supports a baby or small child in a construction made of a textile mesh material and is said to be useful for support of a baby in an aqueous environment, such as a shower or a swimming pool. The baby carriers disclosed in these patents are adjustable in various ways to be suitable for use by adults of different sizes and statures to support babies and young children of different sizes.

However, many known baby and child carriers cannot be worn in multiple modes, are not especially constructed for use in water and snow, are not easy to use and simple to manufacture, are not comfortable to wear, and are not designed to keep a baby's head safely above water when the baby is positioned in the carrier and the adult wearing the baby carrier is in the water. Accordingly, there is a need for a new and improved baby and child carrier that overcomes the problems and limitations associated with known baby and child carriers.

SUMMARY OF INVENTION

The present invention satisfies these needs, as well as provides a unique and advantageous baby and child carrier. None of the known baby and child carrier devices provide all of the numerous advantages of the present invention. Unlike known devices, the present invention provides the following advantageous features: provides an attractive and readily adjustable wearable baby or small child carrier which, when worn in use, leaves the wearer's arms and hands free without risking the baby's safety; provides a wearable baby carrier that can be worn in different ways to provide multiple modes of positioning of a carried baby; provides for a baby or child carrier that is comfortable to wear and is specially constructed for use in water, in snow, and on land; provides for a carrier that is easy to use and assemble with safe, secure and simple closures, and that is simple and inexpensive to manufacture; provides for a carrier that is constructed of a flexible and durable material that is water friendly and buoyant; provides for a carrier that keeps a supported baby or small child warm during and after use of the carrier in water and helps to regulate the baby's body temperature; provides a carrier that keeps a supported baby or small child's head safely above water when the baby or child is positioned in the carrier and the wearer of the carrier is in the water; provides a carrier that can be worn either with a single strap around the user's neck or shoulder or can be converted to double shoulder straps to be worn over the user's shoulders; and provides a carrier designed to carry a baby or small child preferably from four months old to two years old and preferably about ten pounds in weight to about twenty-five pounds in weight.

One version of the present invention provides for a wearable baby carrier comprising: a flexible body having a top end, a bottom end, and side ends, wherein the flexible body comprises a main body sheet and a cover piece substantially covering the main body sheet; an elongated neck strap attached to the top end of the flexible body; a belt strap coupled to the main sheet body, wherein the belt strap has releasable coupling elements which when coupled together position the carrier about a user's waist; at least two receptacle members attached to the bottom end of the flexible body; and, at least two latch members attached to the side ends of the flexible body, wherein when the carrier is in use, the latch members are coupled to the receptacle members and the bottom end of the flexible body is folded upwardly to form a positioning portion, wherein a baby may be positioned within the formed positioning portion.

Another version of the present invention provides for a wearable baby carrier comprising: a flexible body having a top end, a bottom end, and side ends, wherein the flexible body comprises a main body sheet and a cover piece substantially covering the main body sheet; two elongated shoulder straps attached to the top end of the flexible body; a belt strap coupled to the main sheet body, wherein the belt strap has releasable coupling elements which when coupled together position the carrier about a user's waist; at least two receptacle members attached to the bottom end of the flexible body; and, at least two latch members attached to the side ends of the flexible body, wherein when the carrier is in use, the latch members are coupled to the receptacle members and the bottom end of the flexible body is folded upwardly to form a positioning portion, wherein a baby may be positioned within the formed positioning portion.

Another version may comprise a flexible body having a top end, a bottom end, and side ends, wherein the flexible body comprises a main body sheet and a cover piece substantially covering the main body sheet; an elongated strap attached to the top end of the flexible body, wherein the elongated strap may be used as a single neck strap or formed into at least two shoulder straps; a belt strap coupled to the main sheet body, wherein the belt strap has releasable coupling elements which when coupled together position the carrier about a user's waist; at least two receptacle members attached to the bottom end of the flexible body; and, at least two latch members attached to the side ends of the flexible body, wherein when the carrier is in use, the latch members are coupled to the receptacle members and the bottom end of the flexible body is folded upwardly to form a positioning portion, wherein a baby may be positioned within the formed positioning portion.

These and other features, aspects and advantages of the present invention will become better understood from the following description and appended claims.

BRIEF DESCRIPTION OF DRAWINGS

The present invention is shown in the accompanying drawings in which.

DETAILED DESCRIPTION OF INVENTION

Figure 1:
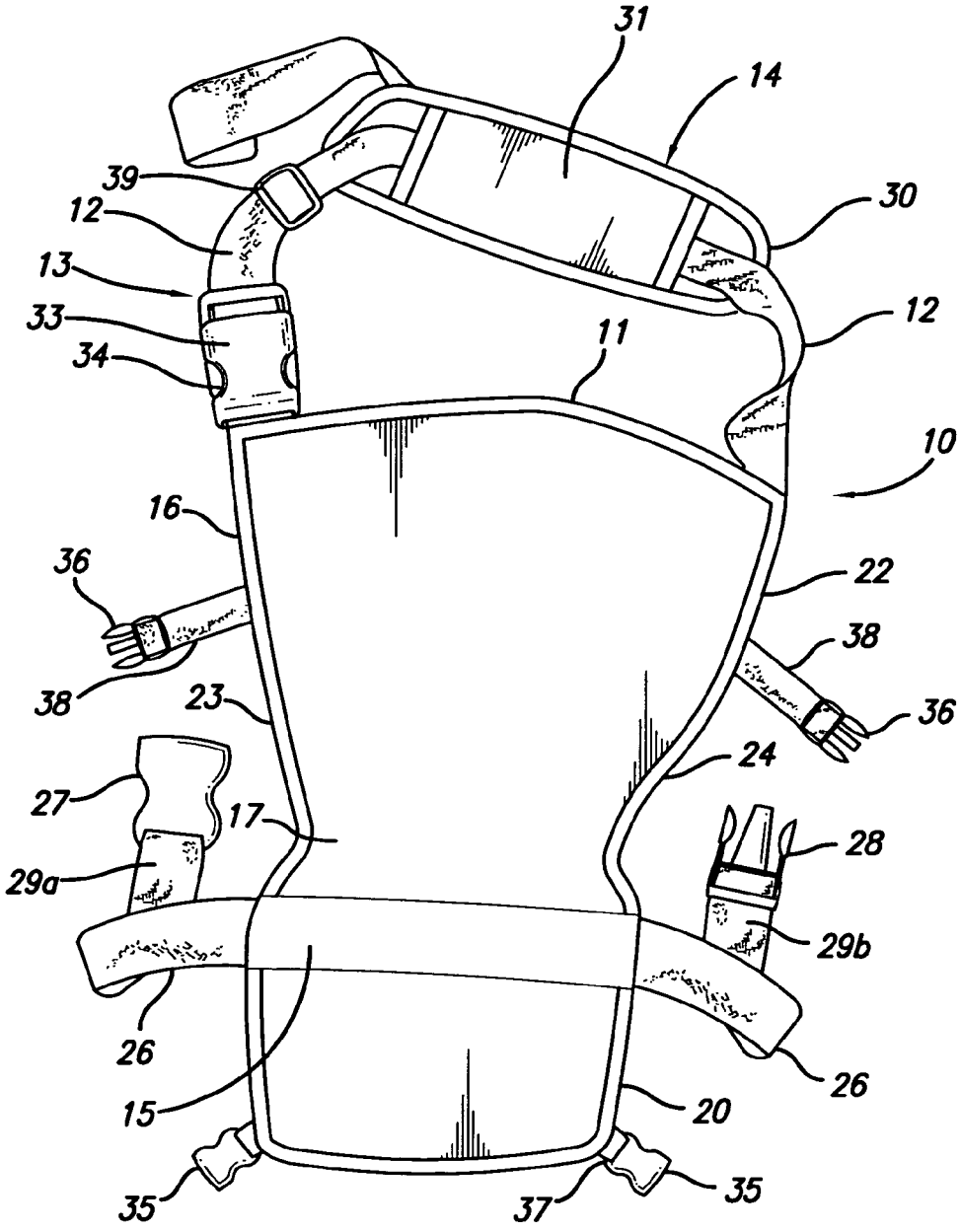
FIG. 1 is a front perspective view of one version of the carrier of the present invention in an opened state.
Figure 3:
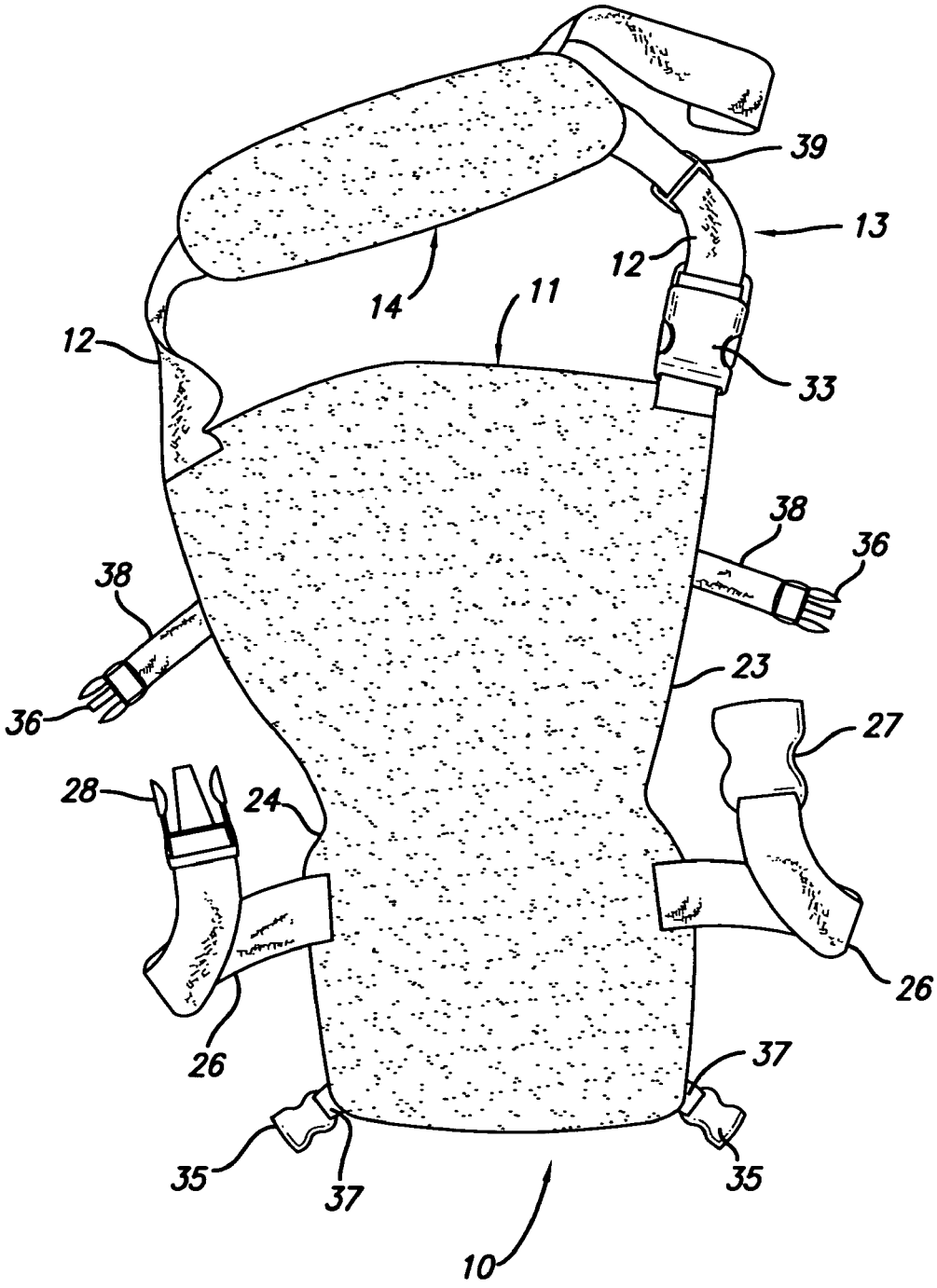
FIG. 3 is a back perspective view of the carrier of FIG. 1 in an opened state.
Figure 4:
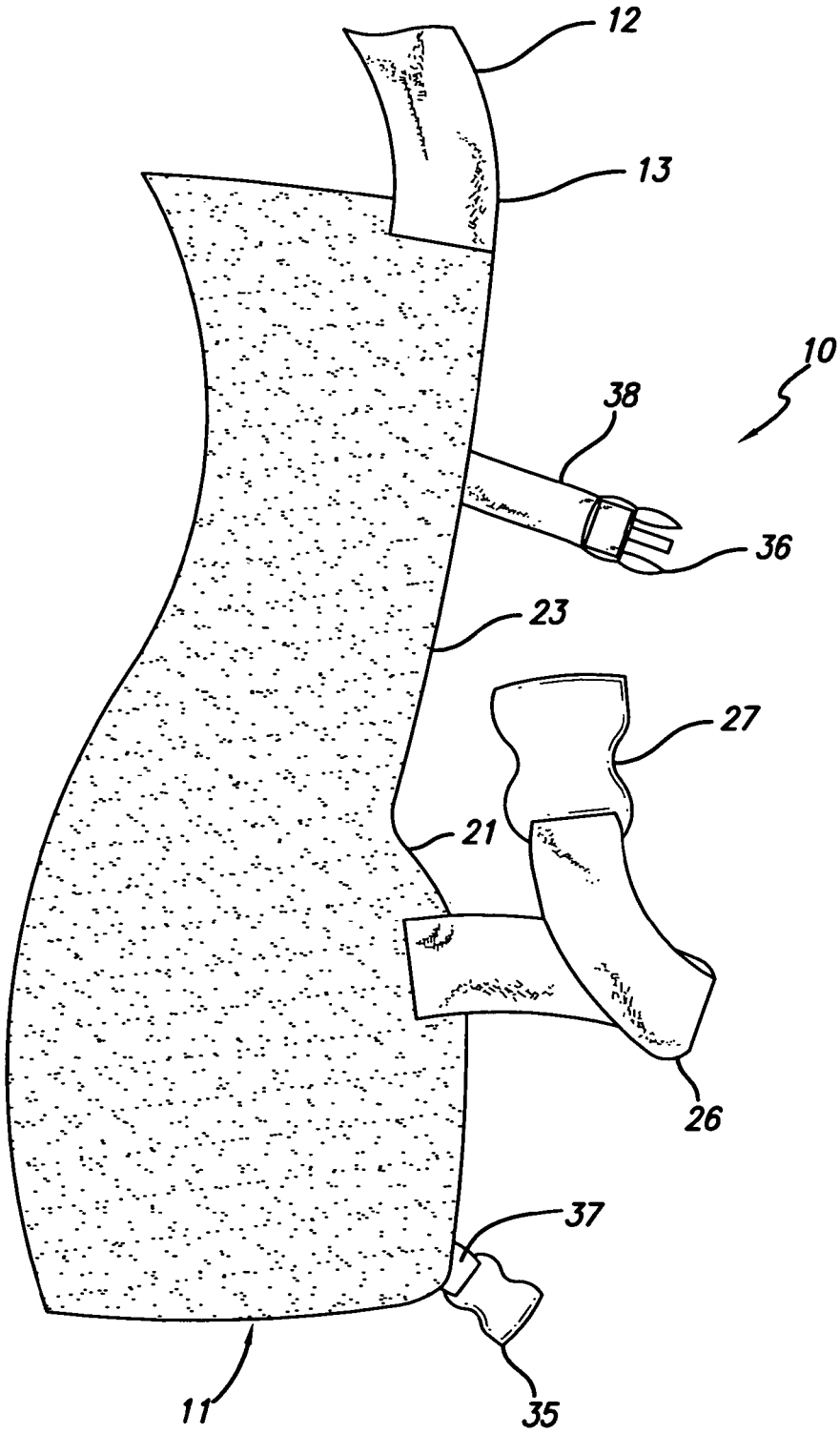
FIG. 4 is a back fragmentary view of a right side portion of the carrier of FIG. 3 where the carrier is in an opened state.
Figure 5:
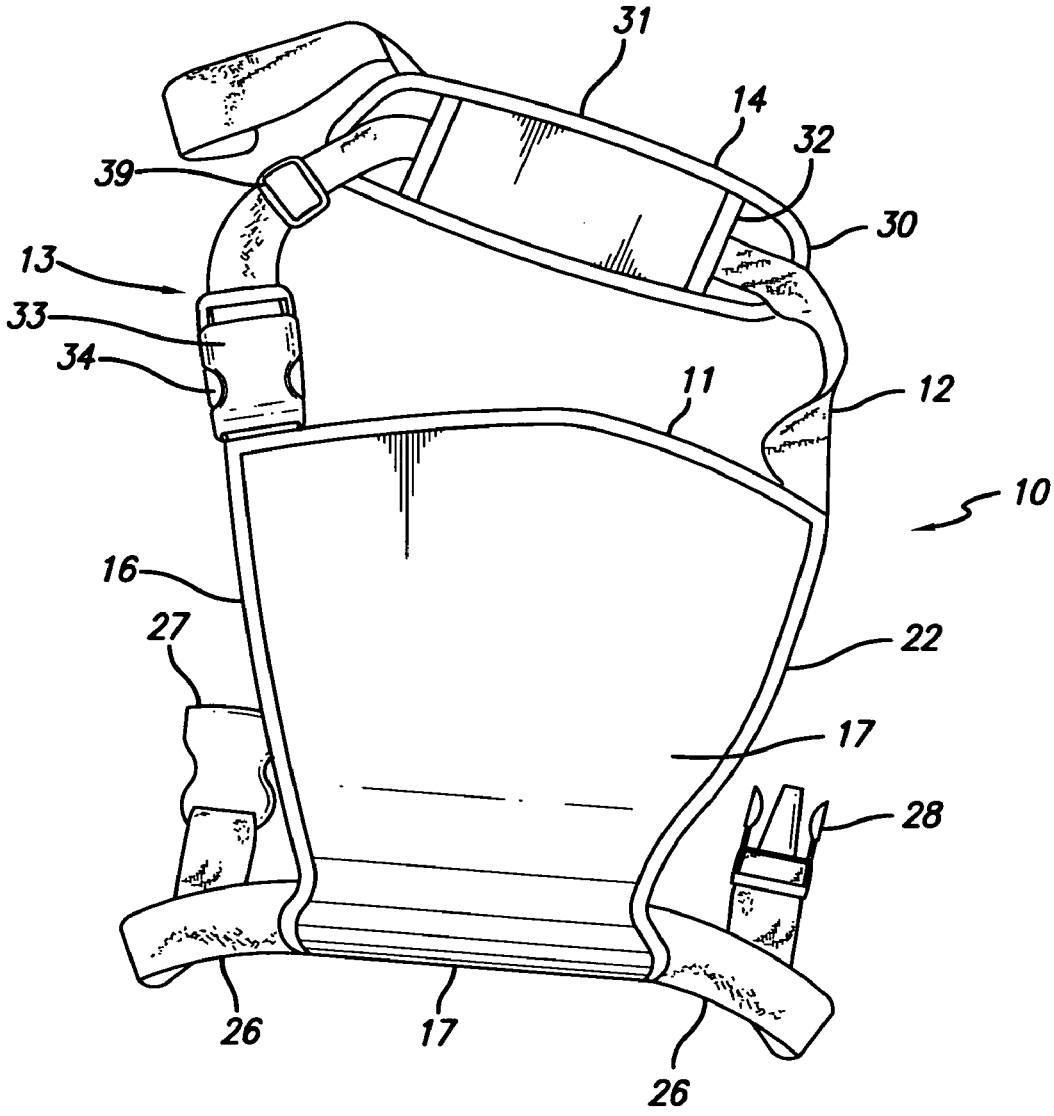
FIG. 5 is a front perspective view of the carrier of FIG. 1, where the carrier is in a folded state and is able to receive a baby or small child in the carrier.
Figure 6:
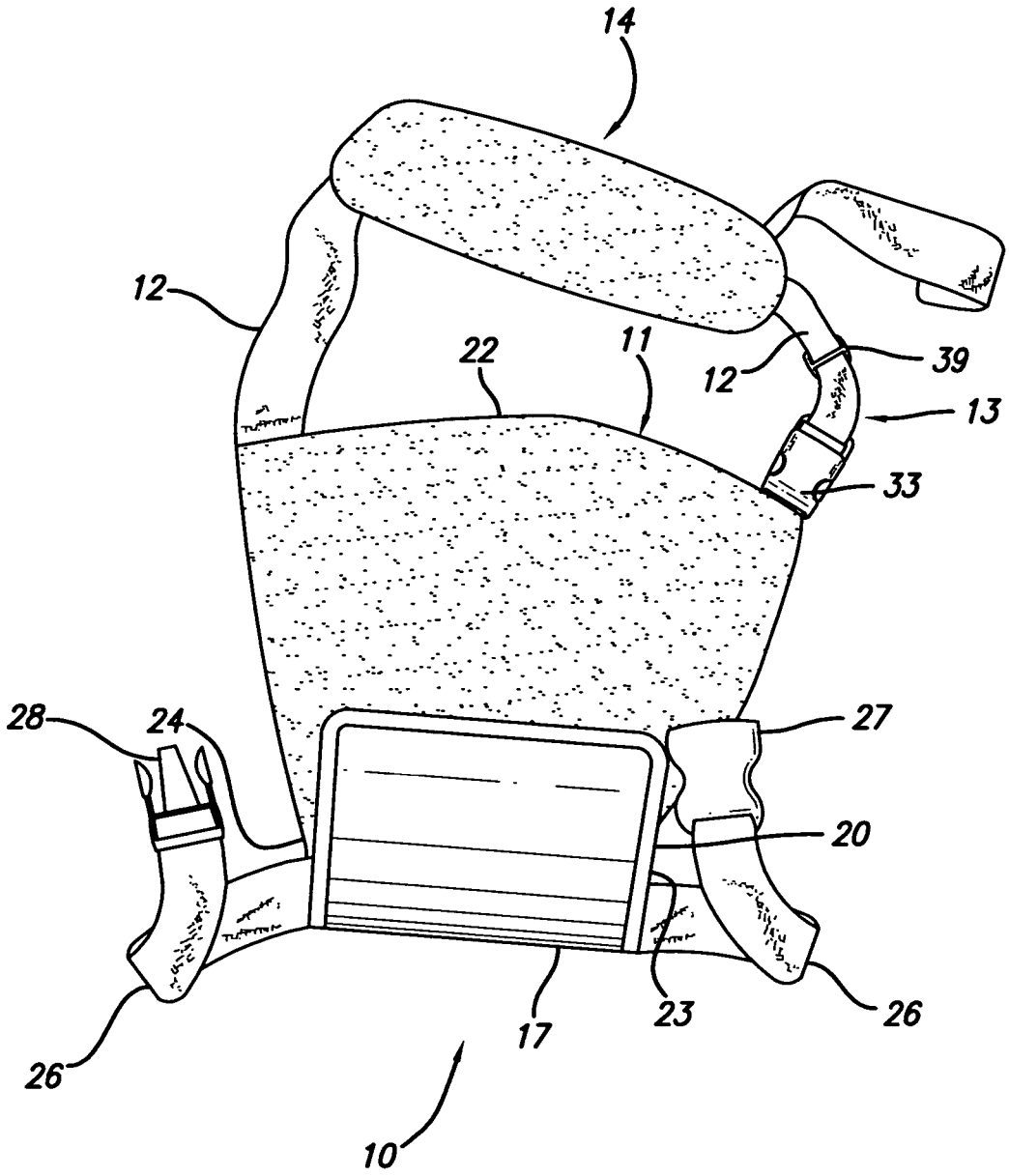
FIG. 6 is a back perspective view of the carrier of FIG. 5, where the carrier is in a folded state and is able to receive a baby or small child in the carrier.

The present invention provides for a baby or small child carrier that in one version comprises a neck strap and in another version can be converted to a child carrier with shoulder straps. One version of the present invention is a baby or small child carrier 10, as shown in FIGS. 1-7 and 18. Another version of the present invention is a baby or small child carrier 100, as shown in FIGS. 8-17. FIGS. 1, 3 and 4 show carrier 10 in an opened state. FIG. 1 is a front perspective view of the carrier 10 in an opened state. FIG. 3 is a back perspective view of the carrier 10 in an opened state. FIG. 4 is a back fragmentary view of a right side portion of the carrier 10 where the carrier is in an opened state.

The carrier is composed of a flexible sheet-like body 11, and an adjustable neck strap 12 which includes at least one releasable connector 13 within its effective length. The carrier 10 preferably also includes a comfort enhancing and load distributing neck pad 14 carried by the neck strap 12. The carrier 10 further includes additional straps and strap connectors at desired places on the carrier body 11, as discussed below. Carrier body 11 is defined as a preferably integrated construction which comprises a main body sheet or piece 16 and a belt guide 15 and cover piece or belt cover piece 17. The main body sheet 16 preferably has the shape and dimensions shown in FIG. 2. The main body sheet 16 and cover piece 17, and preferably also neck pad 14, are made principally of fabric faced, closed cell, synthetic rubber foam sheet material of the kind widely used in the manufacture of wetsuits and other garments for divers and water sport participants. Such fabric faced, closed cell, synthetic rubber foam sheet can be obtained from Nam Liong Enterprise Co., Ltd., of Tainan, Taiwan, as products distributed under the trademark SEAMATE and identified as either BIOPRENE material or CR Series Chloroprene neoprene rubber sheet material. Such foam sheet material is marketed as a laminate of the foam sheet material between two layers of fabric. Woven synthetic fabrics are preferred, and knit synthetic fabrics as the facing laminae are more preferred. The principal material used to define the carrier 10 preferably is a rubber (natural or synthetic) foam material used in sheet form, preferably with a fabric adhered to each side of the sheet. Such fabric-faced foam rubber sheet material preferably is of the kind which is used to make garments for divers and persons engaging in certain water sports. Such foam has a resilient cushioning property and provides both an insulating function and a protective function beneficial to a baby or child supported in the carrier, and such foam helps to keep the baby warm during and after use of the carrier in water and helps to regulate the baby's body temperature. The material is flexible and is water friendly and buoyant. Each individual piece of the fabric-faced foam sheet material in carrier 10 preferably is edged with an elastic binding tape stitched to the foam sheet as cut to the desired shape and size before assembly of those pieces into the carrier body 11 and neck pad 14. Preferably a 3 mm (millimeter) thick to 5 mm (millimeter) thick foam rubber is used. Additional material, such as netting, nylon, spandex, terry cloth or another suitable material may be attached to the foam rubber to achieve a desired decorative look.

Figure 2:
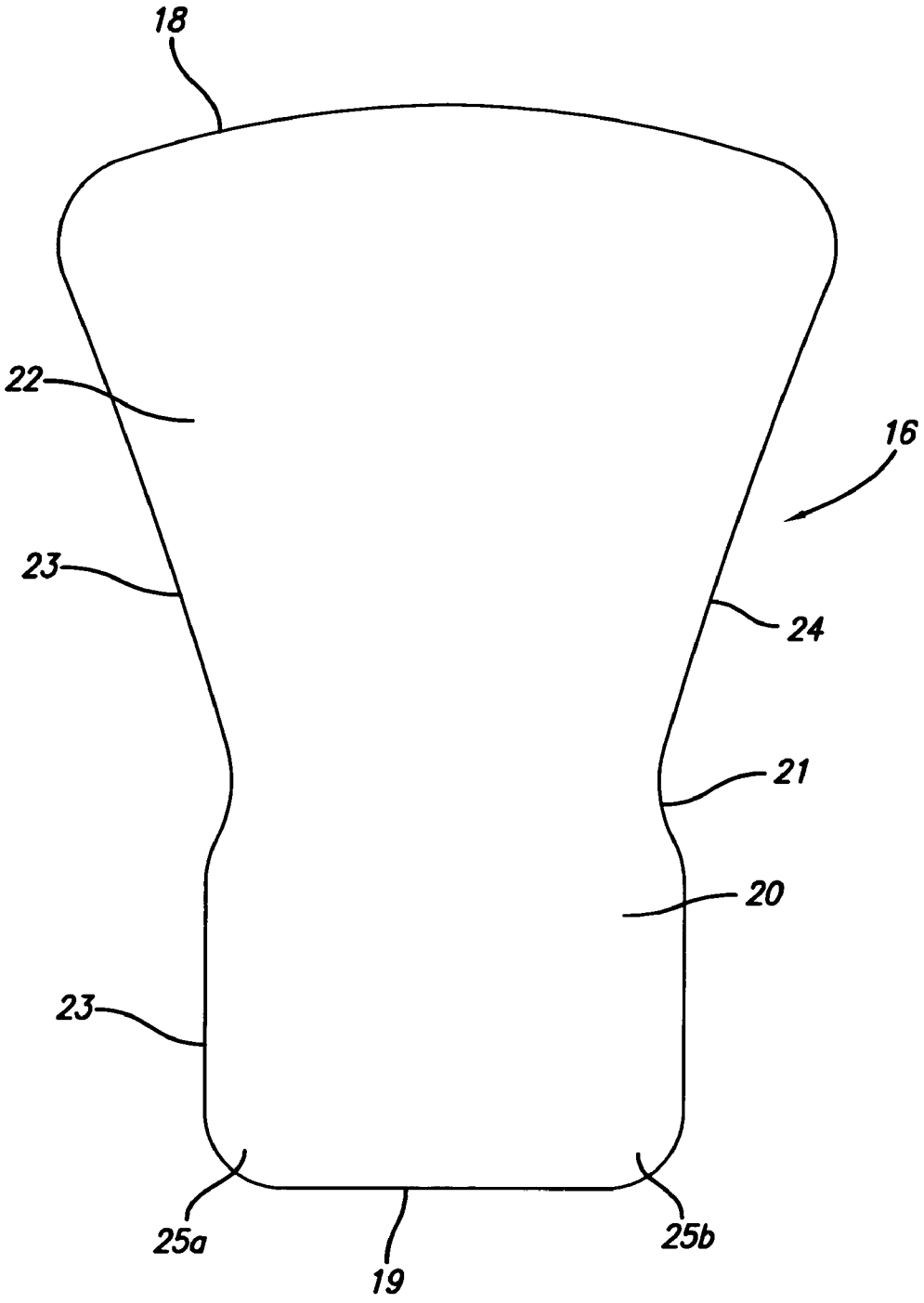
FIG. 2 is a view of the preferred outline shape of the body component of the carrier of FIG. 1.

FIG. 2 is a view of the preferred outline shape of the body component 11 and main body sheet 16 of the carrier 10 of FIG. 1. Main body sheet 16 is symmetrical about a vertical centerline and has a top end edge 18 and a bottom end edge 19. The bottom end edge 19 is substantially straight between preferably curved opposite bottom end corners 25*a*, 25*b* of the body sheet 16. Bottom edge 19 is associated with a substantially rectangular (almost square, preferably) lower section 20 of body sheet 16, which connects via a transition area 21, to an upper section 22 of body sheet 16. The transition area 21 is where body sheet 16 has its minimum width; in that area side edges 23 and 24 of the body sheet 16 are inwardly scalloped to be curved concave outwardly, so that the piece has a modest hourglass waist in the transition area 21. The upper section 22 of body sheet 16 generally has an upwardly and outwardly, preferably linearly flaring configuration, to the maximum width of the body sheet 16 where the side edges 23, 24 are curved to merge into top end edge 18, which preferably is curved convex upwardly of the body sheet 16.

Upper section 22 of body sheet 16 preferably has a height above the lower section 20 which is about twice the height of the lower section 20. The body component in FIG. 2 preferably has a height of approximately 20 inches, a width at the lower section of approximately 9 inches, and a width at the upper section of approximately 14 inches.

As shown in FIG. 1, cover piece 17 has a length transversely of the lower section 20 of body sheet 16 which is about equal to or somewhat less than the width of lower section 20. The cover piece 17 has a width which is modestly greater than the width of belt strap 26. The cover piece 17 is affixed to the front face of body sheet 16 substantially across the upper margin of lower section 20 below and adjacent to transition area 21 of the body sheet 16. The cover piece 17 is affixed to the body sheet 16 by stitching (not shown) along the upper and lower edges of the cover piece 17, but not along its opposite end edges 18, 19. Belt strap 26 is passed through the passage between the cover piece 17 and the body sheet 16 before first and second cooperating releasable coupling moieties or elements 27, 28, respectively, are connected to the opposite ends 29*a*, 29*b* of the belt strap 26. At least one of the coupling elements 27, 28 is adjustably coupled to belt strap 26 so that the effective length of the strap 26 between the coupling elements 27, 28 can be adjusted to correspond to the circumference of the torso of a user of carrier 10 at about the waist of the user. Coupling elements 27, 28 preferably are the cooperating parts of a National Molding 40 mm, MOJAVE STREAMLINE™, releasable buckle assembly. The preferred width of belt strap 26 is about 1.5 inches. The preferred width of neck strap 12 is about 1.5 inches. Neck pad 14 preferably has a length of at least about 11 inches and is composed of a base 30 and a strap cover 31, both of which preferably are defined by respective pieces of fabric faced, closed cell, synthetic rubber foam sheet material of the kind described more fully above. In the same manner as cover piece 17 is affixed to body sheet 16, the strap cover 31 is affixed to the neck strap base 30 so that the neck strap 12 can be passed through the elongate passage 32 between them. One end of neck strap 12 is stitched to body sheet 16 at or adjacent to one of the upper corners of that piece. The connection of a first neck strap end to the body sheet 16 is preferably made to the rear face of the carrier body 11. The connection of a second neck strap end to the body sheet 16 is preferably adjustable in terms of effective strap length, to one of two first and second cooperating releasable neck strap coupling or connector moieties or elements 33, 34, respectively (see FIG. 5), the other connector element of which is carried by a short length of neck strap material which is securely affixed to the carrier body 11 at or adjacent to the other upper corner of that body. Neck strap connector elements 33, 34 can be, and preferably are, components of a second National Molding 40 mm, MOJAVE STREAMLINE™ releasable buckle assembly. The effective length of the neck strap can be adjusted to conform to the torso height of a user of carrier 10 and to reflect and facilitate the desired mode of use of the carrier 10. The neck strap may also include strap adjustor 39 (see FIG. 5).

As shown in FIGS. 1 and 3, carrier 10 includes two additional adjustable straps and releasable coupling arrangements or portions. They are located one at each side of the carrier body 11. They preferably are mirror images of each other, and so only one of them is described in detail. The releasable coupling portion in each of the additional strap and coupling arrangements preferably is a ¾inch side release buckle assembly similar in design to the National Molding releasable buckles described above. Each has a receptacle member 35 into which a cooperating latch member 36 is releasably insertable and engagable. The receptacle member 35 is preferably affixed to a bottom corner of the carrier body 11 by a loop of woven strap material 37 (preferably about ¾ inches wide) which is secured, as by stitching to the back or reverse side of the carrier body 11. The connection of the receptacle member 35 to the carrier body 11 can be nonadjustable in length. The corresponding latch member 36 is adjustably carried on an elongated piece of similar woven strap material 38, one end of which length is securely affixed, as by stitching, to the carrier body 11, preferably on its reverse side, at a location along the corresponding side edge of the carrier body which is between transition area 21 and the corresponding upper section 22 of the carrier body 11. The location of the strap connection for the latch member 36 to the carrier body 11 preferably is a distance above the top edge of the cover piece 17 which is substantially equal to the distance between the top end edge 18 of cover piece 17 and bottom end edge 19 of the carrier body 11. The carrier 10 may further comprise looped locking elements such as VELCRO® pieces to secure the sides of the carrier body when the baby is positioned in the carrier. The cooperating receptacle members 35 and latch members 36 function to hold the carrier in a folded state. That folded state is the state of the carrier body 11 when the carrier is worn by a user, and a baby or small child is supported in the carrier 10. To change the carrier body 11 from its flat or open state shown in FIGS. 1, 3 and 4, to its folded or usage state shown in FIGS. 5-6, the flat carrier body is folded transversely along a line corresponding to the top end edge 18 of the cover piece 17 so that the lower section 20 of the carrier body 11 lies behind the upper section 22. In its folded state, the carrier 10 provides a pouch-like seat or positioning portion into which a baby or small child can be placed with the baby's legs extending out of the opposite sides of the carrier where the carrier body is narrowest. In one orientation, the baby in the carrier faces the person wearing the carrier. In that orientation, the back of the baby is covered by the upper section 22 of the carrier body 11. However, the baby may also be positioned facing away from the user, facing the side of the user, or another suitable position. The closed cell foam material used in the construction of the carrier body is thermally insulating in nature, and so the baby is kept warm by the carrier body and by the body heat of the wearer of the carrier. Maintenance of the body temperature of a baby in the carrier is particularly important when the carrier is used in an aqueous environment, such as a shower, pool, or spa. The closed cell foam material in the carrier body has resilient compressibility, and so provides a cushion-like protective covering for a baby or small child in the carrier. Moreover, that foam material is resiliently deformable to comfortably conform to the contours of a baby or child in the carrier. The preferred material for the several straps of the carrier 10 is a woven synthetic material, such as nylon or polypropylene. Where straps are adjustable in length, adjustability in strap length is provided by use of known three bar strap adjusters.

Figure 7:
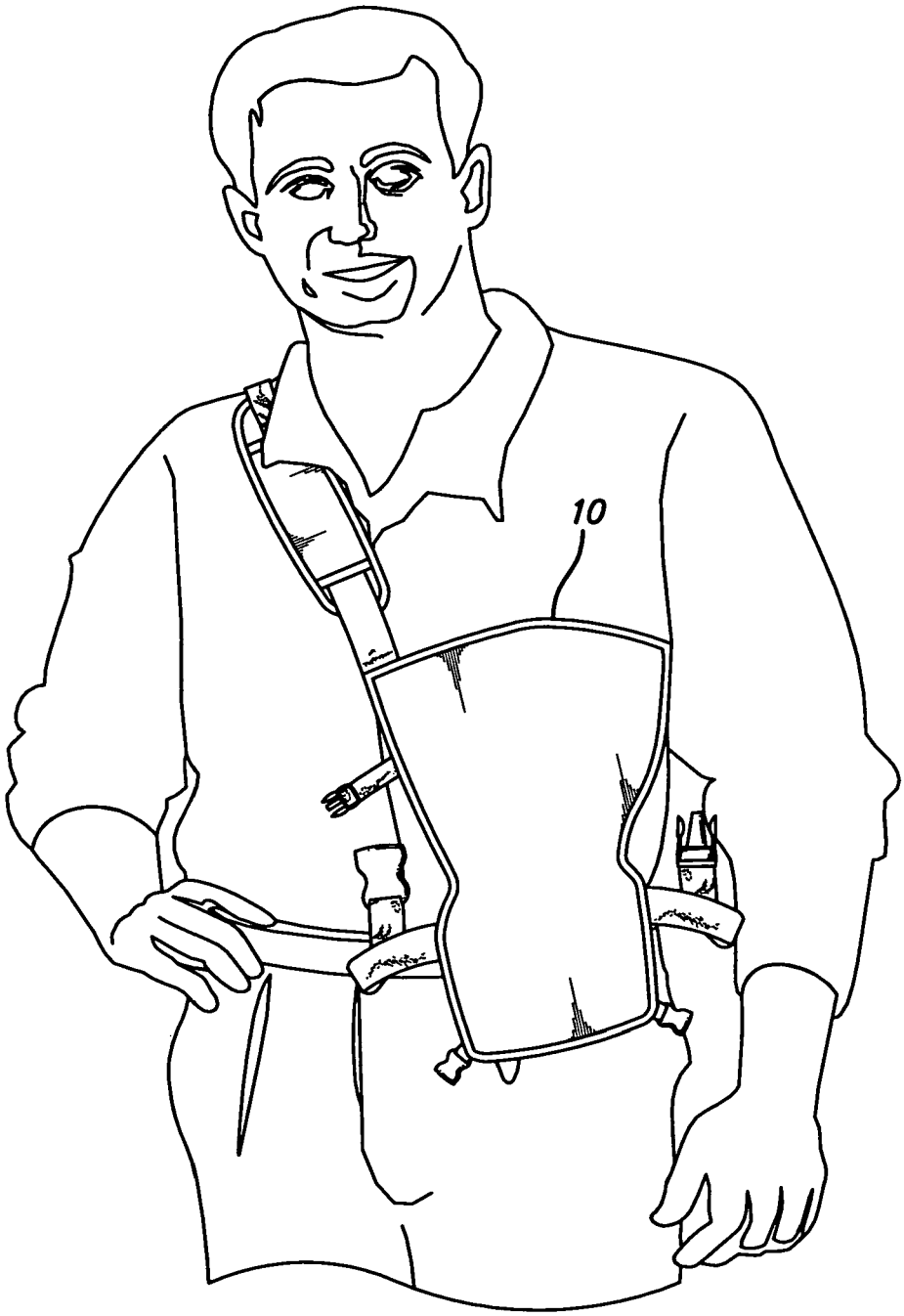
FIG. 7 is a front perspective view of the carrier of FIG. 1, as worn in a usage mode which locates the carrier to the side of the user's torso.
Figure 18:
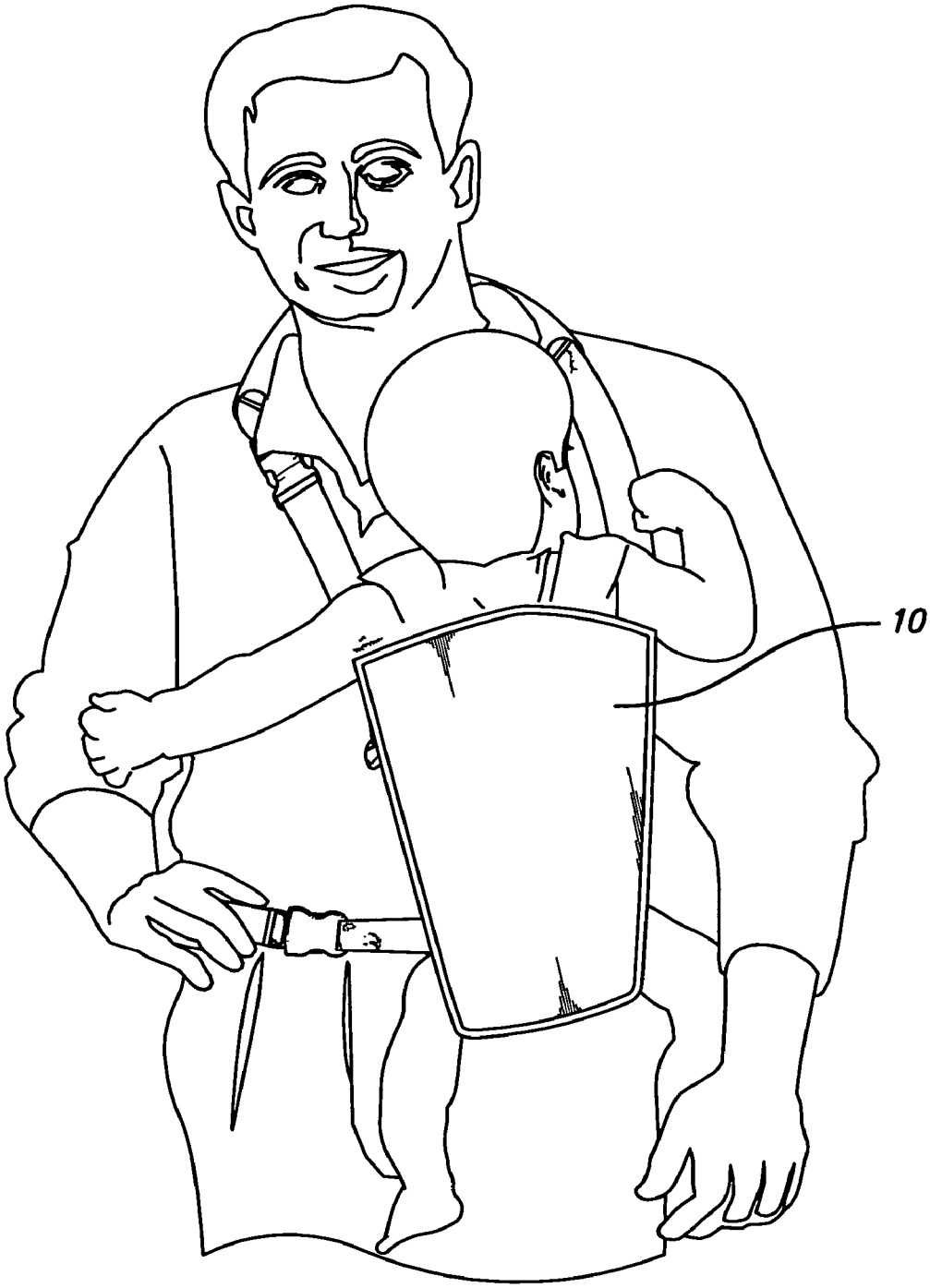

The carrier of FIG. 1 can be worn by a user in several ways. FIG. 7 shows one way the carrier may be worn, in which the carrier is worn to the side of the torso of a user with the neck strap passing over the opposite shoulder of the user and across the user's upper back. The usability of the carrier at the side of the user's torso means that a single user can wear two carriers, one to either side of the torso, to support and carry two babies or small children. Another way the carrier may be worn is that the carrier may be worn directly in front of the torso of a user with the neck strap passing over both shoulders of the user and behind the neck, and the carrier belt strap 26 is engaged around the waist of the user at about the user's belt line. FIG. 18 is a front perspective view of the carrier of the present invention, as worn in a usage mode which locates the carrier to the side of the user's torso and positions the baby facing toward the user.

Figure 8:
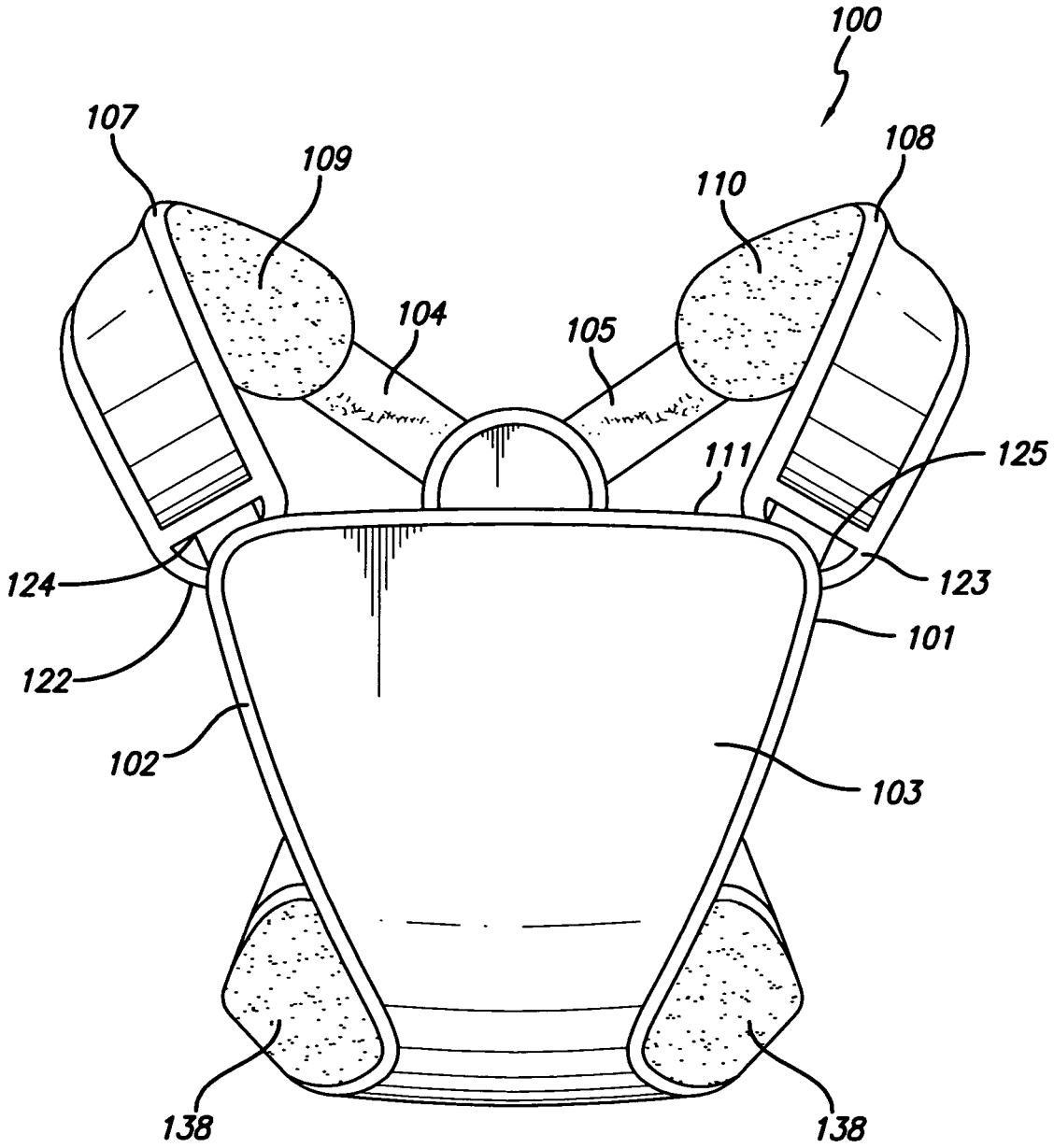
FIG. 8 is a front perspective view of another version of the carrier of the present invention in a folded state.
Figure 15:
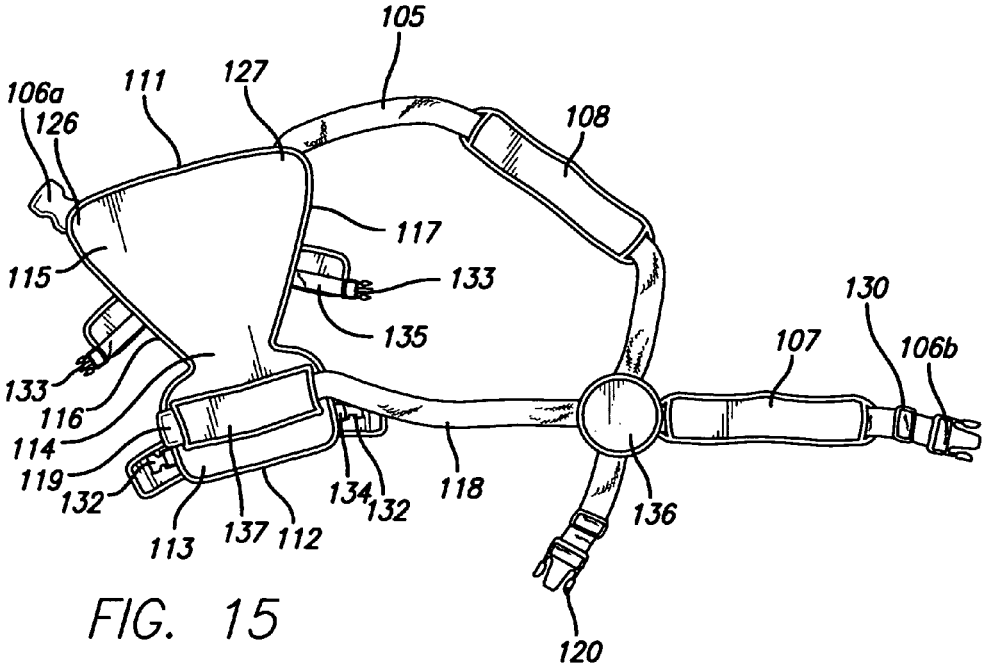
FIG. 15 is a front perspective view of the carrier of FIG. 8 in an opened state.
Figure 16:
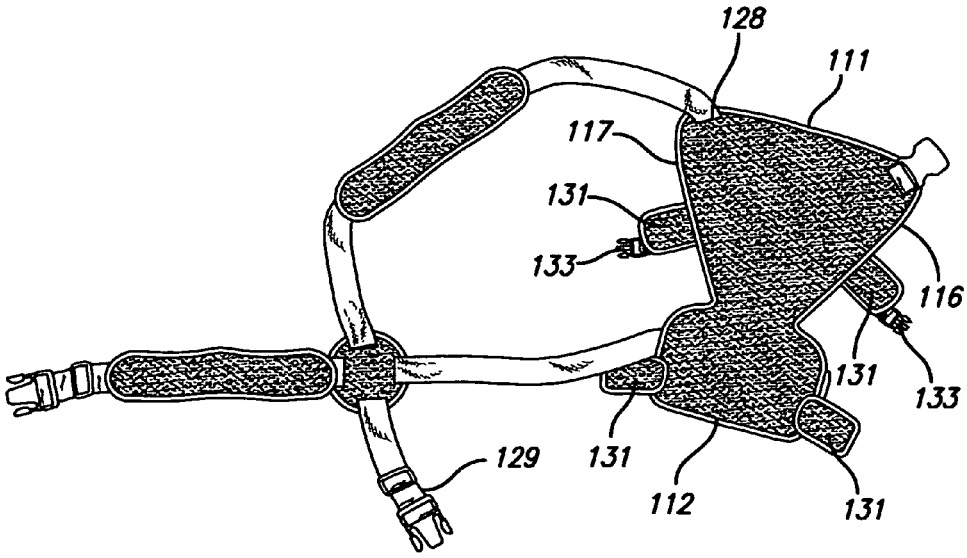
FIG. 16 is a back perspective view of the carrier of FIG. 15 in an opened state.

FIG. 8 is a front perspective view of another version of the carrier of the present invention in a folded state. FIG. 15 is a front perspective view of the carrier of FIG. 8 in an opened state. FIG. 16 is a back perspective view of the carrier of FIG. 15 in an opened state. This embodiment is directed to a carrier 100 having a flexible sheet-like carrier body 101. The carrier body 101 comprises a main body sheet 102 and a cover piece 103. The carrier 100 further comprises adjustable first and second shoulder straps 104, 105, respectively, which include at least one set of releasable connector elements 106*a*, 106*b* (see FIG. 9) within its effective length. The carrier 100 preferably also includes comfort enhancing and first and second load distributing shoulder pads 107, 108, respectively, carried by the shoulder straps 104, 105. The shoulder pads 107, 108 each have a pad cover 109, 110, respectively. The carrier 100 further includes additional straps and strap connectors at desired places on the carrier body 101, as discussed further below.

The body sheet 102 and cover piece 103, and preferably also the shoulder pads 107, 108 are made principally of fabric faced, closed cell, synthetic rubber foam sheet material of the kind widely used in the manufacture of wetsuits and other garments for divers and water sport participants. Such fabric faced, closed cell, synthetic rubber foam sheet can be obtained from Nam Liong Enterprise Co., Ltd., of Tainan, Taiwan, as products distributed under the trademark SEAMATE and identified as either BIOPRENE material or CR Series Chloroprene neoprene rubber sheet material. Such foam sheet material is marketed as a laminate of the foam sheet material between two layers of fabric. Woven synthetic fabrics are preferred, and knit synthetic fabrics as the facing laminae are more preferred. The principal material used to define the carrier 100 preferably is a rubber (natural or synthetic) foam material used in sheet form, preferably with a fabric adhered to each side of the sheet. Such fabric-faced foam rubber sheet material preferably is of the kind which is used to make garments for divers and persons engaging in certain water sports. Such foam has a resilient cushioning property and so provides both an insulating function and a protective function beneficial to a baby or child supported in the carrier. Each individual piece of the fabric-faced foam sheet material in carrier 10 preferably is edged with an elastic binding tape stitched to the foam sheet as cut to the desired shape and size before assembly of those pieces into the carrier body 101 and shoulder pads 107, 108. Preferably a 3 mm (millimeter) thick to 5 mm (millimeter) thick foam rubber is used. Additional material, such as netting, nylon, spandex, terry cloth or another suitable material may be attached to the foam rubber to achieve a desired decorative look.

Main body sheet 102 is symmetrical about a vertical centerline and has a top end edge 111 and a bottom end edge 112. The bottom end edge 112 is substantially straight between preferably curved opposite bottom end corners of the body sheet 102. Bottom edge 112 is associated with a substantially rectangular (almost square, preferably) lower section 113 of body sheet 102, which connects via a transition area 114, to an upper section 115 of body sheet 102. The transition area 114 is where body sheet 102 has its minimum width; in that area side edges 116, 117 of the body sheet 102 are inwardly scalloped to be curved concave outwardly, so that the piece has a modest hourglass waist in the transition area 114. The upper section 115 of body sheet 102 generally has an upwardly and outwardly, preferably linearly flaring configuration, to the maximum width of the body sheet 102 where the side edges 116, 117 are curved to merge into top end edge 111, which preferably is curved convex upwardly of the body sheet 102. Upper section 115 of body sheet 102 preferably has a height above the lower section 113 which is about twice the height of the lower section 113.

Figure 9:
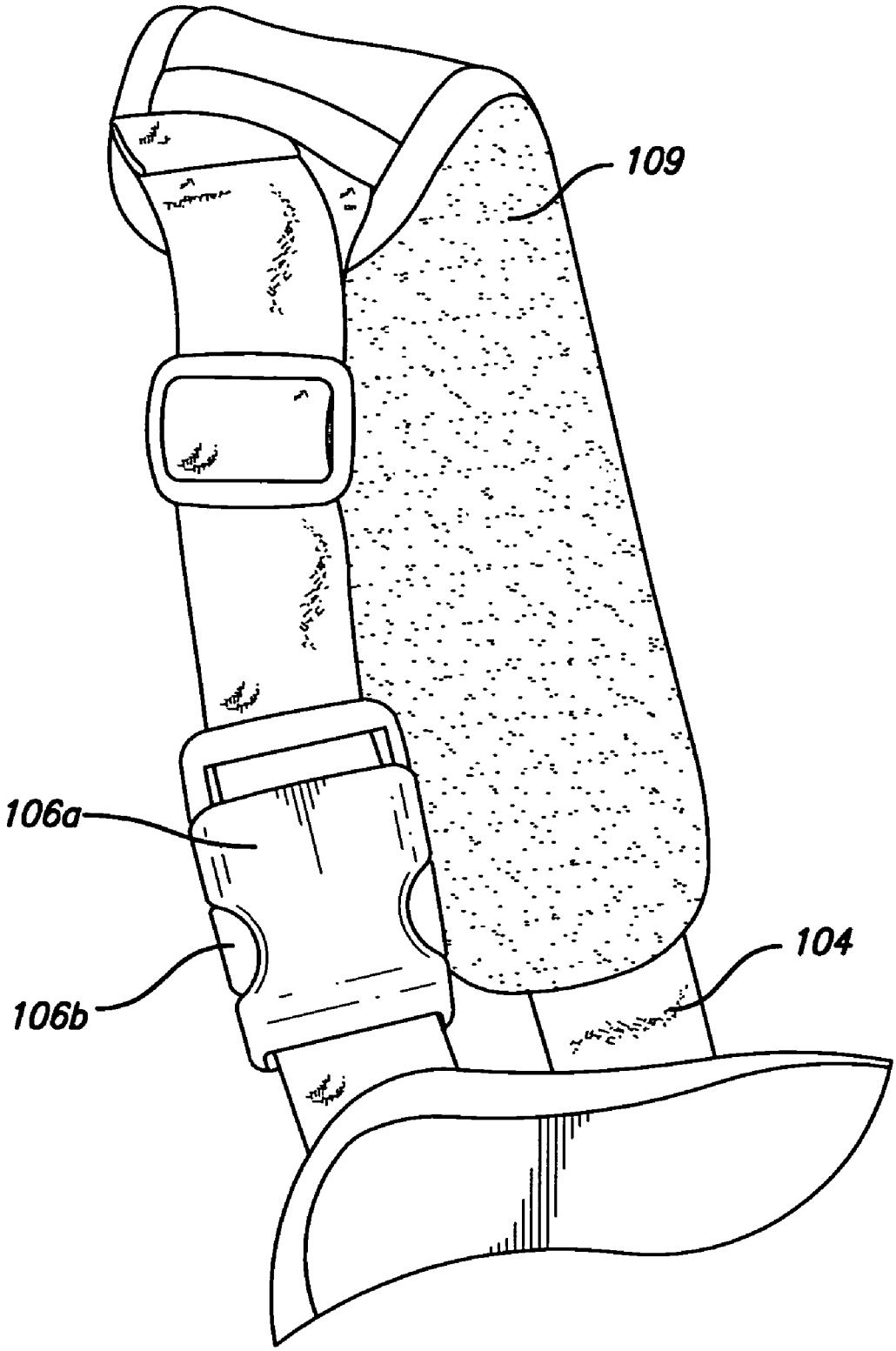
FIG. 9 is a front fragmentary view of the connector element of the shoulder strap portion of the carrier.
Figure 10:
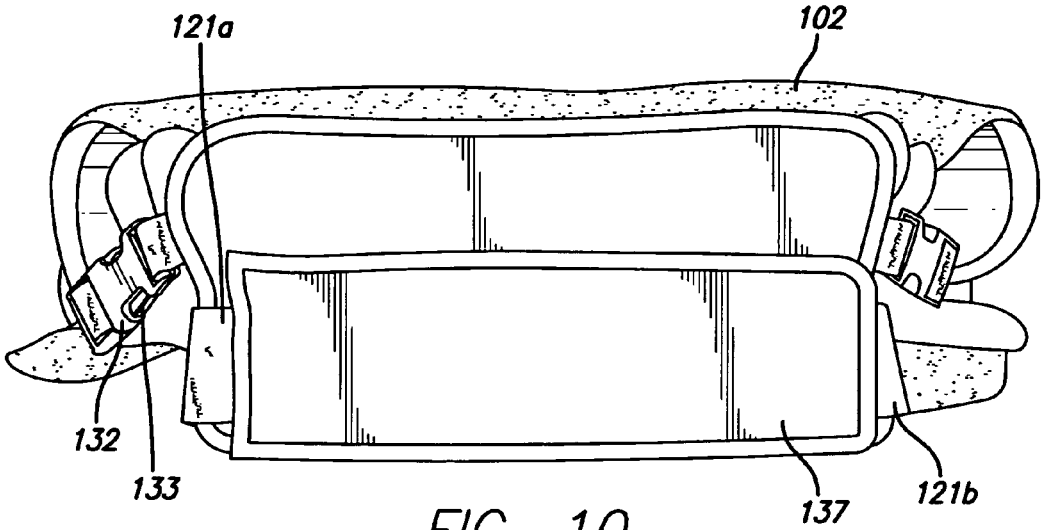
FIG. 10 is a back view of the lower portion of the carrier of FIG. 8.

As shown in FIG. 15, cover piece 103 has a length transversely of the lower section 113 of body sheet 102 which is about equal to or somewhat less than the width of lower section 113. The cover piece 103 has a width which is modestly greater than the width of belt strap 118. The cover piece 103 is affixed to the front face of body sheet 102 substantially across the upper margin of lower section 113 below and adjacent to transition area 114 of the body sheet 102. The cover piece 103 is affixed to the body sheet 102 by stitching (not shown) along the upper and lower edges of the cover piece 103, but not along its opposite end edges 111, 112. Belt strap 118 is passed through the passage between the cover piece 103 and the body sheet 102 before first and second cooperating releasable coupling moieties or elements 119, 120, respectively, are connected to the opposite ends 121*a*, 121*b* of the belt strap 118. At least one of coupling elements 119, 120 is adjustably coupled to belt strap 118 so that the effective length of the strap 118 between the coupling elements 119, 120 can be adjusted to correspond to the circumference of the torso of a user of carrier 100 at about the waist of the user. Coupling elements 119, 120 preferably are the cooperating parts of a National Molding 40 mm, MOJAVE STREAMLINE™, releasable buckle assembly. The preferred width of belt strap 118 is about 1.5 inches. The preferred width of shoulder straps 104, 105 is about 1.5 inches. Shoulder pads 107, 108 preferably have a length of at least about 11 inches and are composed of strap covers 109, 110 and base 122, 123, both of which preferably are defined by respective pieces of fabric faced, closed cell, synthetic rubber foam sheet material of the kind described more fully above. In the same manner as cover piece 103 is affixed to body sheet 102, the strap covers 109, 110 are affixed to the shoulder strap bases 122, 123 so that the shoulder straps 104, 105 can be passed through the first and second elongate passages 124, 125, respectively, between them. One end of each shoulder strap 104, 105 is coupled to body sheet 102 at or adjacent to one of the upper corners 126, 127 of that piece. The connection of first shoulder strap end 128 to the body sheet 102 is preferably made to the rear face of the carrier body 101. The connection of second shoulder strap end 129 to the body sheet 102 is preferably adjustable in terms of effective strap length, to at least one cooperating releasable shoulder strap connector 106 *a, b*. Shoulder strap connector element 106 *a, b* can be, and preferably is, a component of a second National Molding 40 mm, MOJAVE STREAMLINE™ releasable buckle assembly. The effective length of the each shoulder strap can be adjusted to conform to the torso height of a user of carrier 100 and to reflect and facilitate the desired mode of use of the carrier 100. FIG. 9 is a front fragmentary view of the connector element 106 *a, b* of the shoulder strap portion. FIG. 10 is a back view of the lower portion of the carrier 100 of FIG. 8. The carrier 100 may further include strap adjustor 130 (FIG. 15).

Figure 11:
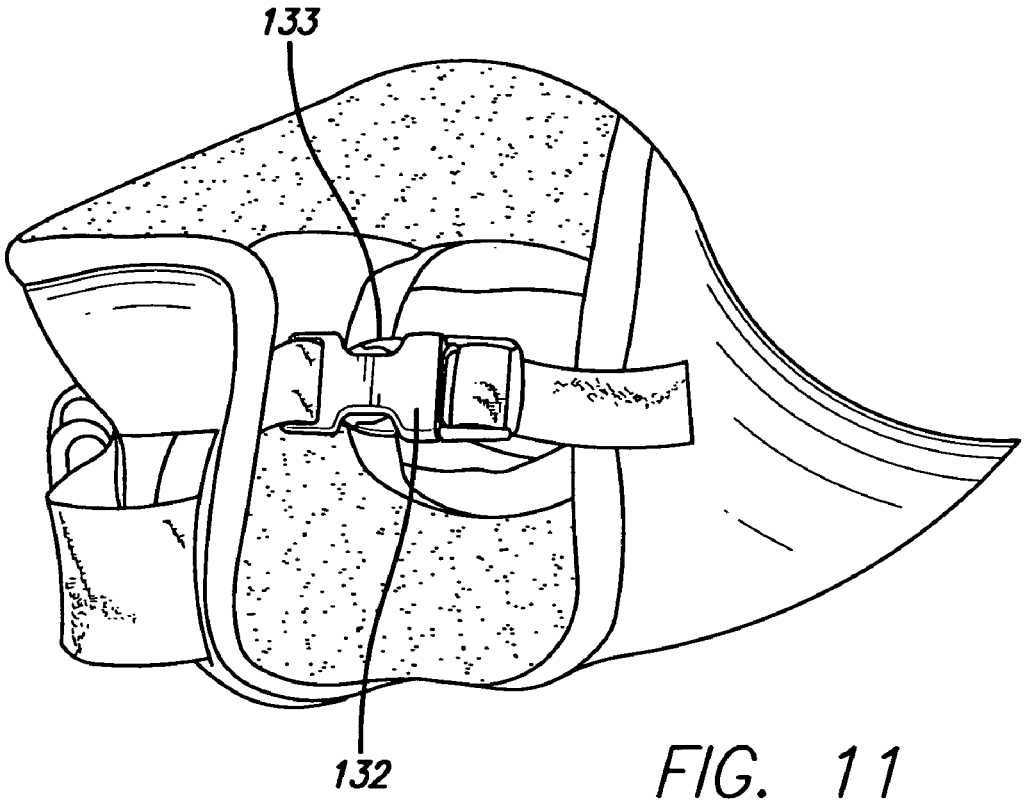
FIG. 11 is a side fragmentary view of the latch member and receptacle member of the carrier of FIG. 10.

As shown in FIGS. 10 and 11, carrier 100 includes two additional adjustable straps and releasable coupling arrangements or portions. They are located one at each side of the carrier body 101. They preferably are mirror images of each other, and so only one of them is described in detail. FIG. 11 is a side fragmentary view of the coupling arrangement comprising a latch member and receptacle member. The releasable coupling portion in each of the additional strap and coupling arrangements preferably is at least a ¾ inch side release buckle assembly similar in design to the National Molding releasable buckles described above. Each has a receptacle member 132 into which a cooperating latch member 133 is releasably insertable and engagable. The receptacle member 132, preferably, is affixed to a bottom corner of the carrier body 102 by a loop of woven strap material 134 preferably at least about ¾ inches wide which is secured, as by stitching to the back or reverse side of the carrier body 101. The connection of the receptacle member 132 to the carrier body 101 can be nonadjustable in length. The corresponding latch member 133 is adjustably carried on an elongated piece of similar woven strap material 135, one end of which length is securely affixed, as by stitching, to the carrier body 101, preferably on its reverse side, at a location along the corresponding side edge of the carrier body which is between transition area and the corresponding upper section of the carrier body 101. The location of the strap connection for the latch member 133 to the carrier body 101 preferably is a distance above the top edge of the cover piece 103 which is substantially equal to the distance between the top end edge of cover piece 103 and bottom end edge of the carrier body 101. FIG. 10 also shows belt guide 137 through which belt strap 118 is inserted through. The carrier 100 may further comprise looped locking elements 131, such as VELCRO® pads, to secure the sides of the carrier body when the baby is positioned in the carrier.

Figure 12:
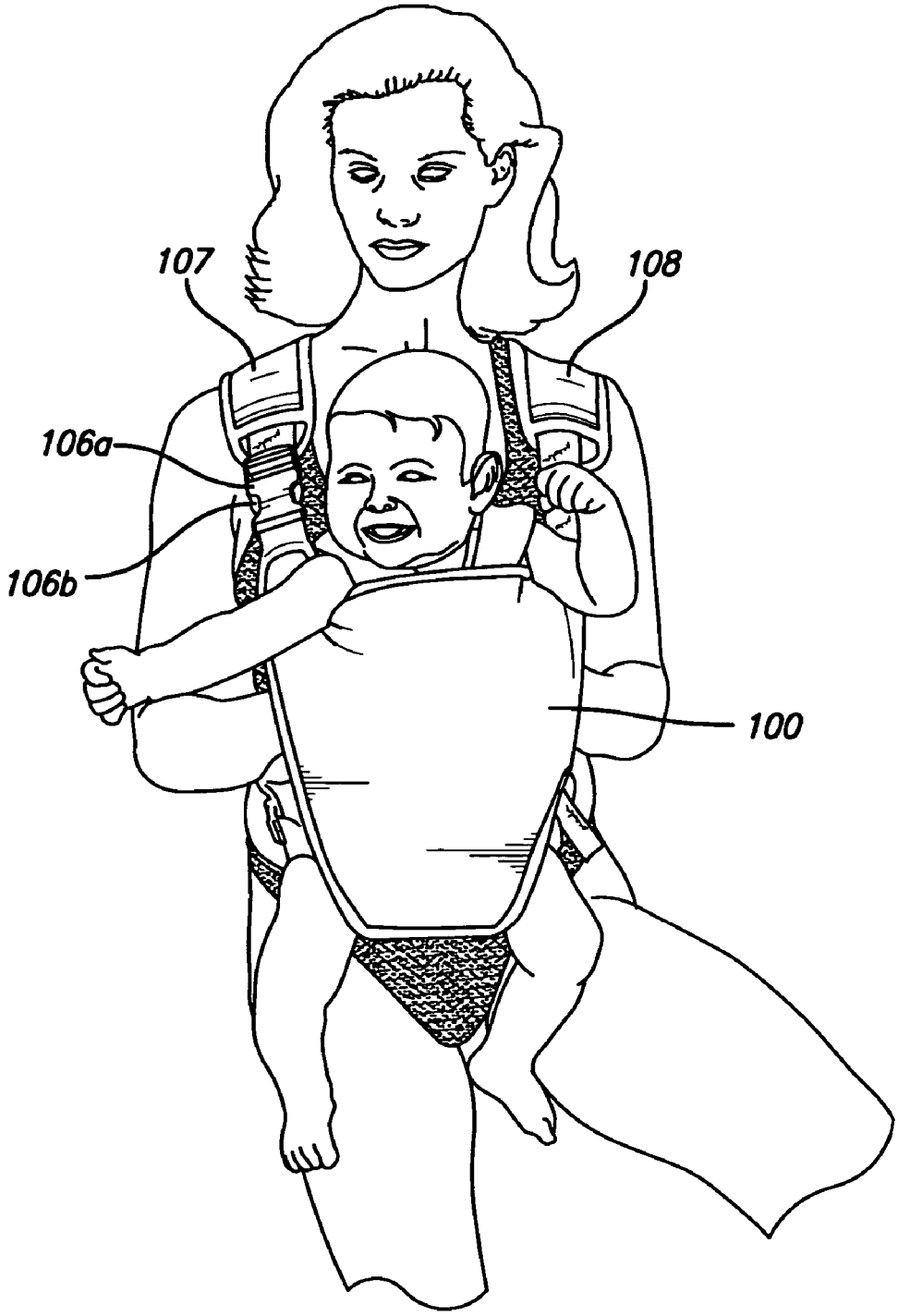
FIG. 12 is a front perspective view of the carrier of FIG. 8, as worn in a usage mode which locates the carrier in front of the user's torso and positions the baby facing away from the user.

The cooperating receptacle member 132 and latch member 133 function to hold the carrier in a folded state as shown best in FIGS. 8 and 12. That folded state is the state of the carrier body 101 when the carrier is worn by a user, and a baby or small child is supported in the carrier 100. To change the carrier body 101 from its flat or open state shown in FIGS. 15, 16, to its folded or usage state shown in FIGS. 8, 12, the flat carrier body is folded transversely along a line corresponding to the top end edge of the cover piece 103 so that the lower section of the carrier body 101 lies behind the upper section. In its folded state, the carrier 100 provides a pouch-like seat or positioning portion into which a baby or small child can be placed with the baby's legs extending out of the opposite sides of the carrier where the carrier body is narrowest. The baby may be positioned in the carrier 100 facing away from the person wearing the carrier. In that orientation, the back of the baby is against the user and the front torso of the baby is covered by the upper section of the carrier body 101. The baby's head, arms and legs are free and able to move easily. However, the baby may also be positioned facing toward the user or in other suitable positions. The closed cell foam material used in the construction of the carrier body is thermally insulating in nature, and so the baby is kept warm by the carrier body and by the body heat of the wearer of the carrier. Maintenance of the body temperature of a baby in the carrier is particularly important when the carrier is used in an aqueous environment such as a shower, pool, or spa. The closed cell foam material in the carrier body has resilient compressibility, and so provides a cushion-like protective covering for a baby or small child in the carrier. Moreover, that foam material is resiliently deformable to comfortably conform to the contours of a baby or child in the carrier. The preferred material for the several straps of the carrier 100 is a woven synthetic material, such as nylon or polypropylene. Where straps are adjustable in length, adjustability in strap length is provided by use of known three bar strap adjusters.

Figure 13:
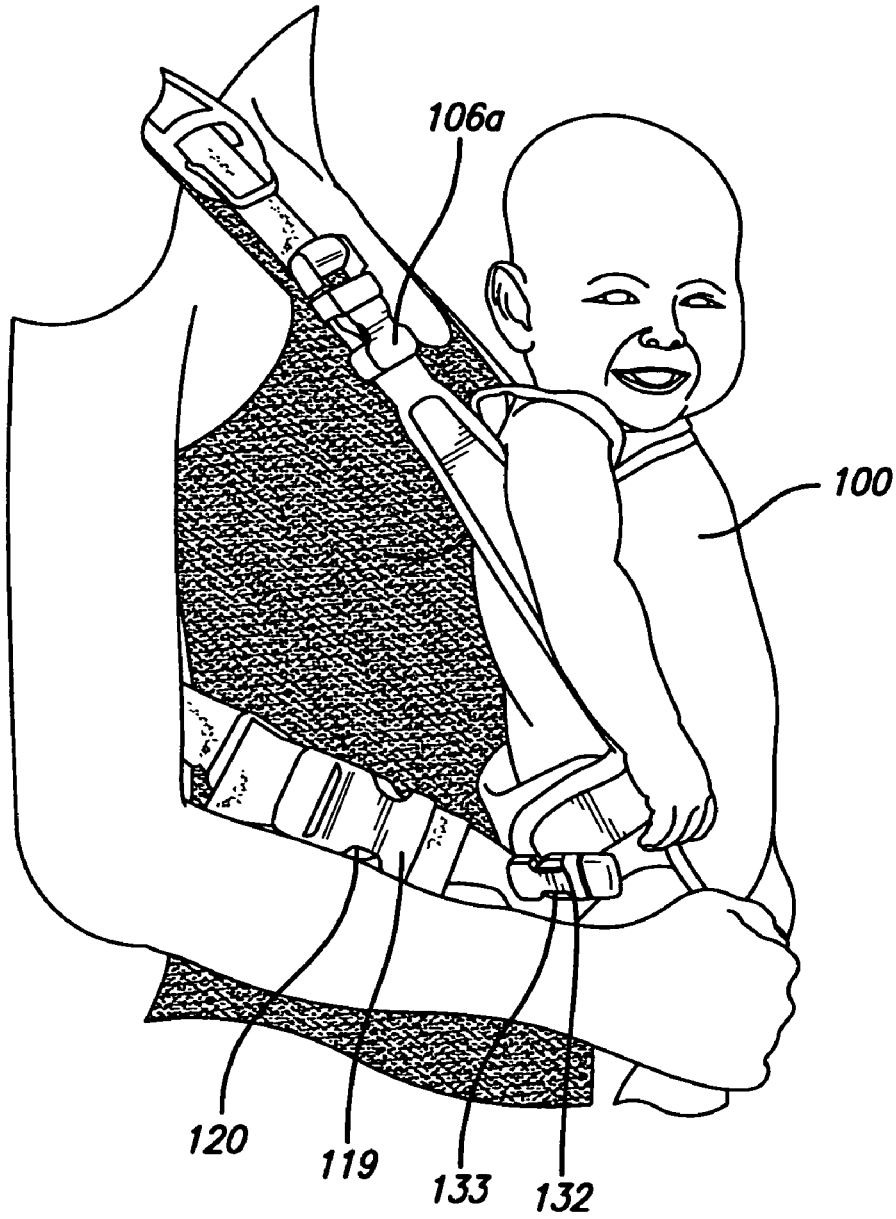
FIG. 13 is a side perspective view of the carrier of FIG. 12, as worn in a usage mode.
Figure 14:
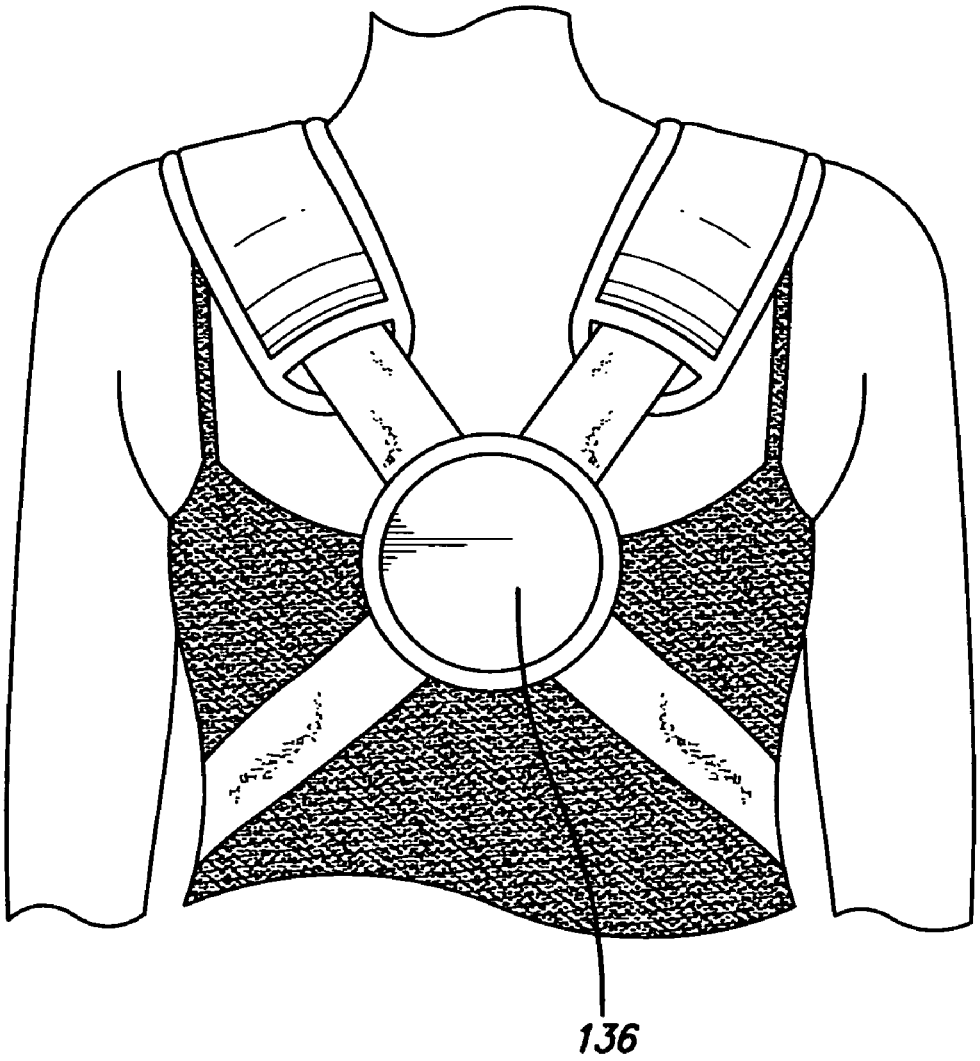
FIG. 14 is a back view of the carrier of FIG. 12, as worn in a usage mode.
Figure 17:
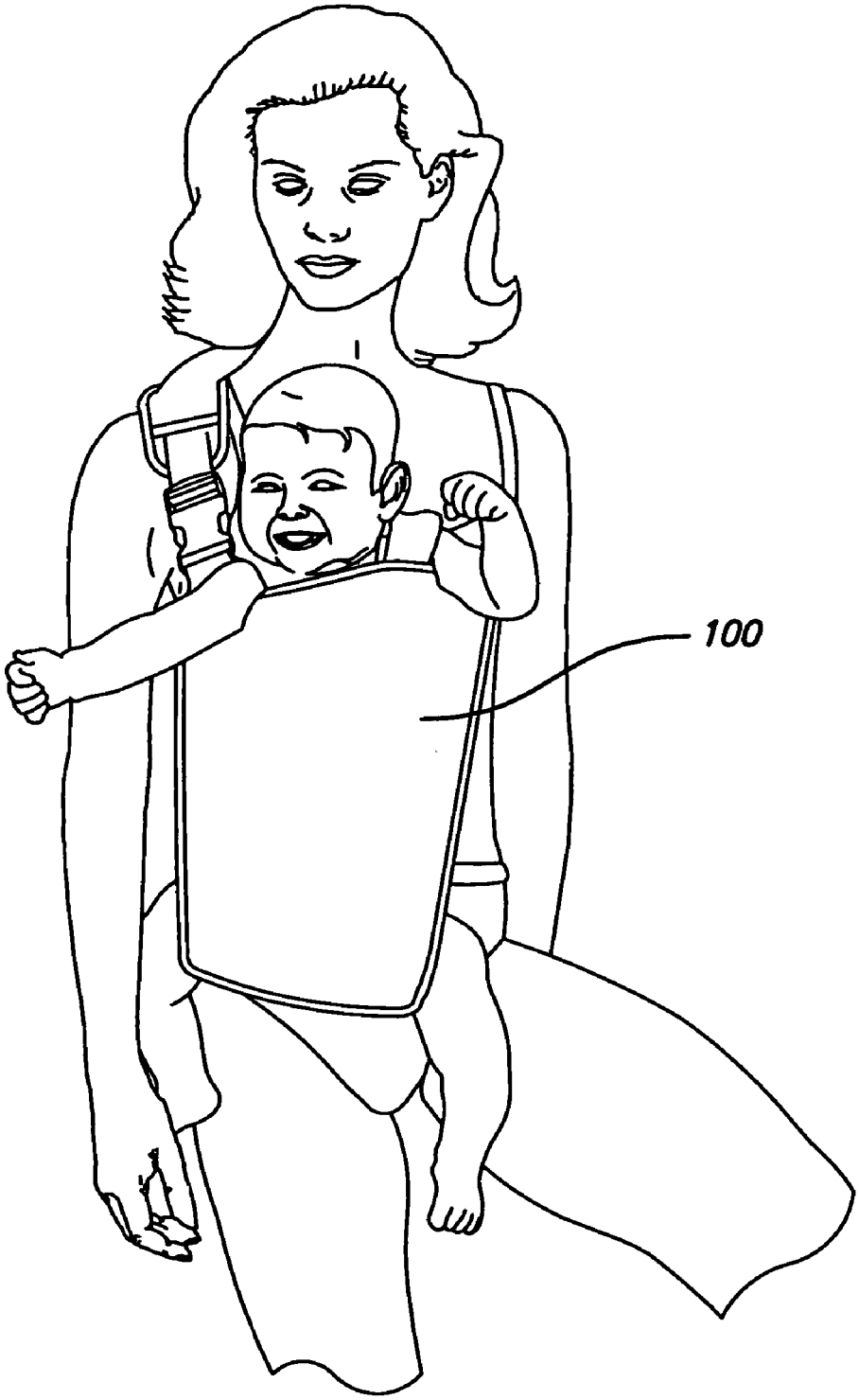
FIG. 17 is a front perspective view of the carrier of the present invention, as worn in a usage mode which locates the carrier to the side of the user's torso and positions the baby facing away from the user; and, FIG. 18 is a front perspective view of the carrier of the present invention, as worn in a usage mode which locates the carrier to the side of the user's torso and positions the baby facing toward the user.

FIGS. 12-14 show how the carrier 100 may be worn. FIG. 12 is a front perspective view of the carrier in the folded state as worn in a usage mode which locates the carrier in front of the user's torso with the baby facing outwardly. FIG. 13 is a side perspective view of the carrier of FIG. 12, as worn in a usage mode. FIG. 14 is a back view of the carrier of FIG. 12, as worn in a usage mode. The carrier may comprise a back pad 136 for use with the shoulder straps. As shown in FIG. 14, the shoulder straps cross over each other along the back of a user, and the shoulder straps are inserted through one side of the back pad 136. FIG. 17 is a front perspective view of the carrier of the present invention, as worn in a usage mode which locates the carrier to the side of the user's torso and positions the baby facing away from the user.

Both versions of the carrier of the present invention provide for an attractive and readily adjustable wearable baby or child carrier which, when worn in use, leaves the wearer's arms and hands free, as well as the baby's head, arms and legs free. The carrier of the present invention provides for a baby or small child carrier that is comfortable to wear, attractive, easy to assemble and wear, and is especially constructed for use in water, on land, and in snow. In addition, the carrier of the present invention allows a user to keep a supported baby or child warm during and after use of the carrier in water, and allows a user to keep a supported baby or child's head safely above water when the baby or child is positioned in the carrier and the user is in the water.

When the shoulder strap version of the carrier is worn by a user, preferably the user first couples the shoulder straps to the carrier body and couples the waist strap to the carrier body and then slips the carrier over the user's head. Preferably, the carrier's front should be in the front of the user's torso, and the user's torso should be between the shoulder straps and the waist strap. The straps of the carrier may be adjusted to fit the user's body. Once the carrier is secured on the user, the user preferably unfastens the shoulder connector 106 *a,b* and carefully places the baby in the carrier. The baby's legs may be inserted into leg openings 138 (FIG. 8) formed when the body sheet is folded and the latch members and receptacle members are coupled together. Once the baby is positioned in the carrier, either facing outward or toward the user, the user preferably fastens the shoulder connector element under the baby's arm to cocoon the baby in the carrier. The baby's arms are allowed to rest comfortably over the front of the carrier. In order to convert the shoulder strap version to the neck strap version, the user preferably unbuckles strap 104 at connector element 106 *a, b*. The shoulder strap 104 is pulled through the back pad 136 so that the shoulder straps 104, 105 are separated. Strap 105 is unbuckled at waist buckle and then coupled to shoulder buckle. The user slips the strap 105 over the user's head and arm with the carrier on the front of the user's hip for side use and over the user's neck for front use. The user buckles strap 104 into the waist buckle and adjusts the strap so it sits snug on the user's waist. The user may fasten the shoulder buckle under the baby's arm to cocoon the baby in the carrier. The baby's arms may rest comfortably over the front of the carrier (see FIG. 17). To take the baby out of the carrier, the user may unfasten the receptacle and latch members and unbuckle the shoulder or neck straps and slide the baby upwards and out. Preferably, the carrier of the contemplated apparatus is designed to carry a baby or small child preferably from four months old to two years old and preferably weighing about ten pounds to about twenty-five pounds.

Although the present invention has been described in considerable detail with reference to certain preferred aspects thereof, other aspects of the invention are possible. Therefore, the scope of the appended claims should not be limited to the description of the preferred aspects contained herein.

What is claimed is:

1. A method of using a wearable baby carrier, comprising: providing a flexible body having a top end, a bottom end, side ends, one elongated neck strap and one belt strap, wherein the flexible body comprises a main body sheet and a cover piece substantially covering the main body sheet;

the one elongated neck strap attached to the top end of the flexible body, wherein the one elongated neck strap is convertible, along with the one belt strap, into shoulder straps with the addition of a back pad, and wherein the one elongated neck strap comprises a neck strap connector element that cooperatively couples to a corresponding connector element on the one belt strap or to a corresponding shoulder connector element on the main body sheet;

the one belt strap coupled to the main body sheet, wherein the one belt strap has releasable coupling elements which when coupled together position the carrier about a user's waist and wherein the one belt strap is convertible, along with the one elongated neck strap, into shoulder straps with the addition of a back pad, and wherein the one belt strap comprises a belt strap connector element that cooperatively couples to a corresponding connector element on the one belt strap or to a corresponding shoulder connector element on the main body sheet;

providing at least two receptacle members attached to the bottom end of the flexible body;

providing at least two latch members attached to the side ends of the flexible body, wherein when the carrier is in use, the latch members are coupled to the receptacle members and the bottom end of the flexible body is folded upwardly to form a positioning portion, wherein a baby may be positioned within the positioning portion; and converting the one elongated neck strap, along with the one belt strap, into shoulder straps with the addition of the back pad.

2. The method of use of claim 1, wherein the flexible body is comprised of a neoprene rubber sheet material.

3. The method of use of claim 1, wherein the neck strap has a neck pad coupled to the neck strap.

4. The method of use of claim 1, wherein the belt strap is a woven synthetic material.

5. The method of use of claim 1, wherein the carrier is especially suited for use in water and in snow.

6. The method of use of claim 1, wherein the carrier may be positioned either in front of the torso of the user or to either side of the torso of the user when in use.

7. The method of use of claim 1, wherein the one elongated strap includes a releasable connector element and a strap adjustor.

8. The method of use of claim 1, wherein the carrier further comprises looped locking elements.

* * * * *